United States Patent [19]

Vadakin et al.

[11] Patent Number: 4,690,159

[45] Date of Patent: Sep. 1, 1987

[54] ROTARY CLEANING DEVICE

[75] Inventors: Thomas C. Vadakin; Thomas A. Hoenigman, both of Marietta, Ohio

[73] Assignee: Vadakin, Inc., Marietta, Ohio

[21] Appl. No.: 809,718

[22] Filed: Dec. 17, 1985

[51] Int. Cl.[4] ..... B08B 9/02

[52] U.S. Cl. ..... 134/167 C; 134/168 C; 134/172; 134/198; 122/392; 122/405; 165/95

[58] Field of Search ..... 134/172, 174, 180, 181, 134/167 C, 167 R, 179, 168 R, 22.11, 198; 239/264, 225, 255, 227, 242; 122/392, 405; 165/95

[56] References Cited

U.S. PATENT DOCUMENTS

| | | | |
|---|---|---|---|
| 2,497,171 | 2/1950 | Jones et al. | 134/167 C X |
| 2,945,628 | 7/1960 | Broughton | 239/242 X |
| 3,101,730 | 8/1963 | Harris et al. . | |
| 3,247,969 | 4/1966 | Miller | 239/264 X |
| 3,477,178 | 11/1969 | Hulbert, Jr. . | |
| 3,599,871 | 8/1971 | Ruppel et al. . | |
| 3,696,825 | 10/1972 | Guignon et al. . | |
| 3,836,434 | 9/1974 | Novy . | |
| 3,878,857 | 4/1975 | Heibo | 134/180 X |
| 3,961,983 | 6/1976 | Crandall et al. . | |
| 3,987,963 | 10/1976 | Pacht . | |
| 4,163,455 | 8/1979 | Hebert et al. . | |
| 4,212,248 | 7/1980 | Maybury | 134/167 C X |
| 4,341,232 | 7/1982 | Maton | 134/168 R X |
| 4,603,661 | 8/1986 | Nelson et al. | 134/167 C |

*Primary Examiner*—Harvey C. Hornsby
*Assistant Examiner*—Frankie L. Stinson
*Attorney, Agent, or Firm*—Laubscher & Laubscher

[57] ABSTRACT

An improved rotary cleaning device for cleaning the inner surface of a cylindrical housing is disclosed, characterized by a unique mounting and fluid distribution shaft. A flixed support is axially arranged within the housing and the shaft is mounted on the support for longitudinal displacement along the housing axis. A swivel device is rotatably connected with the shaft and a pair of cleaning lances are connected with the swivel. High pressure cleaning fluid is delivered to the lances via the shaft and the swivel to abrasively clean the inner wall surface of the cylindrical housing. A drive mechanism is connected with the swivel to rotate the swivel and cleaning lances about the shaft. When the drive mechanism is operated to rotate the swivel and when the shaft is axially displaced along the support, the cleaning lances traverse both orbital and linear paths to direct the cleaning fluid against th entire interior surface area of the cylindrical wall of the housing.

11 Claims, 3 Drawing Figures

70
72
74
64
62
66
58
80
28
76
68
44
16
46
18
26
26
14
8
22
20a
20b
24
78
78
20
50
48
32
58
62

ROTARY CLEANING DEVICE

BACKGROUND OF THE INVENTION

The present invention relates to an improved rotary cleaning device for cleaning the interior surface of a cylindrical housing such as a cyclone furnace or boiler. The device includes a pair of rotary lances which deliver cleaning fluid under high pressure across the entire surface area of the interior of the housing cylindrical wall to remove particulates, grease, grime and the like from the wall.

BRIEF DESCRIPTION OF THE PRIOR ART

Rotary spray devices for cleaning the interior of a housing are well-known in the patented prior art as evidenced by the U.S. patents to Hebert et al U.S. Pat. No. 4,163,455, Hulbert U.S. Pat. No. 3,477,178, and Harris et al U.S. Pat. No. 3,101,730. The Hebert et al patent, for example, discloses a rotary cleaning apparatus for ship holds wherein a central support is vertically arranged in the hold and a carriage is connected with the support for movement along the length thereof. A nozzle assembly is rotatably connected with the carriage to sweep across the inner surface of the ship hold.

The Hulbert patent discloses a device for cleaning the interior of a cylindrical housing such as a railroad tank car. A triangular support frame is arranged along the axis of the housing and a carriage is mounted thereon. A nozzle is connected with the carriage which moves both axially and rotationally within the housing. The nozzle directs cleaning fluid against the inner surfaces of the housing to abrasively clean the same. The patent to Harris et al discloses a rotary spray tube arranged within a housing for washing the interior thereof. While the prior devices normally operate satisfactorily, they each possess inherent drawbacks which limit their effectiveness and versatility. The Hebert et al and Hulbert devices, for example, are incapable of continuous rotation in one direction without winding the fluid and power supply lines about the support. Moreover, both devices are extremely bulky, difficult to install and remove, and limited in their cleaning potential owing to the less than optimum arranged of the cleaning nozzles relative to the wall surface to be cleaning. Furthermore, the Harris et al device, bacause it lacks extended nozzles, is incapable of directing the cleaning fluid against the interior surfaces with sufficient force to produce in abrasive cleaning.

The present invention was developed in order to overcome these and other drawbacks of the prior devices by providing a rotary cleaning device which is capable of continuous rotation in either direction about the axis of the housing and capable of longitudinal displacement to direct a high pressure cleaning fluid against the entire surface area of the interior walls of a cylindrical housing to abrasively clean the same.

SUMMARY OF THE INVENTION

Accordingly, it is a primary object of the present invention to provide a rotary cleaning device for cleaning the inner surface of a furnace, boiler, or other cylindrical housing. A fixed support cable is connected with the ends of the housing and extends along the housing axis. A cylindrical shaft containing an axial through-bore is mounted on the cable with the cable arranged in the through-bore. The shaft is adapted for axial displacement along the cable, and a swivel member is rotatably connected with the shaft for rotation about the axis of the housing. A cleaning device is connected with the swivel and includes a pair of lances extending in radially opposite directions from the swivel. At the end of each lance is a nozzle arranged adjacent the surface to be cleaned. A sprocket is connected with the swivel and is driven by a motor to rotate the swivel about the shaft and thus about the axis of the housing. A source of cleaning fluid is connected with the cleaning device for supplying fluid under high pressure to the nozzles. When the motor is operated to rotate the swivel and the cleaning lances about the housing axis and when the shaft is axially displaced along the cable, the nozzles traverse both orbital and linear paths to direct the cleaning fluid under high pressure against the entire surface area of the cylindrical wall of the housing to abrasively clean the interior surface thereof.

According to another object of the invention, the shaft contains an elongated annular passage concentrically arranged relative to and isolated from the through-bore. The shaft also includes a plurality of fluid inlet openings connecting the passage with the source of cleaning fluid and a plurality of fluid outlet openings connecting the passage with the cleaning lances, whereby the cleaning fluid is delivered to the cleaning device from the fluid source via the passage in the shaft.

According to a more specific object of the invention, the shaft contains an insert which defines the annular passage. The insert is arranged in the through-bore of the shaft and also contains a through-bore which is adapted to receive the cable, the diameter of the insert through-bore corresponding with the diameter of the cable. The end portions of the insert have an outer diameter corresponding with the inner diameter of the shaft. The intermediate portion of the insert, which extends between the inlet and outlet openings in the shaft, has an outer diameter less than the outer diameter of the end portions to define the annular passage between the inner surface of the shaft and the outer surface of the insert intermediate portion.

It is a further object of the invention to arrange the nozzles at an angle relative to the lances, whereby the force generated by the high pressure cleaning fluid as it is discharged from the nozzles tends to displace the shaft in one direction along the cable.

According to yet another object of the invention, a displacement controlling device is connected with the shaft to control the displacement of the shaft along the cable.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
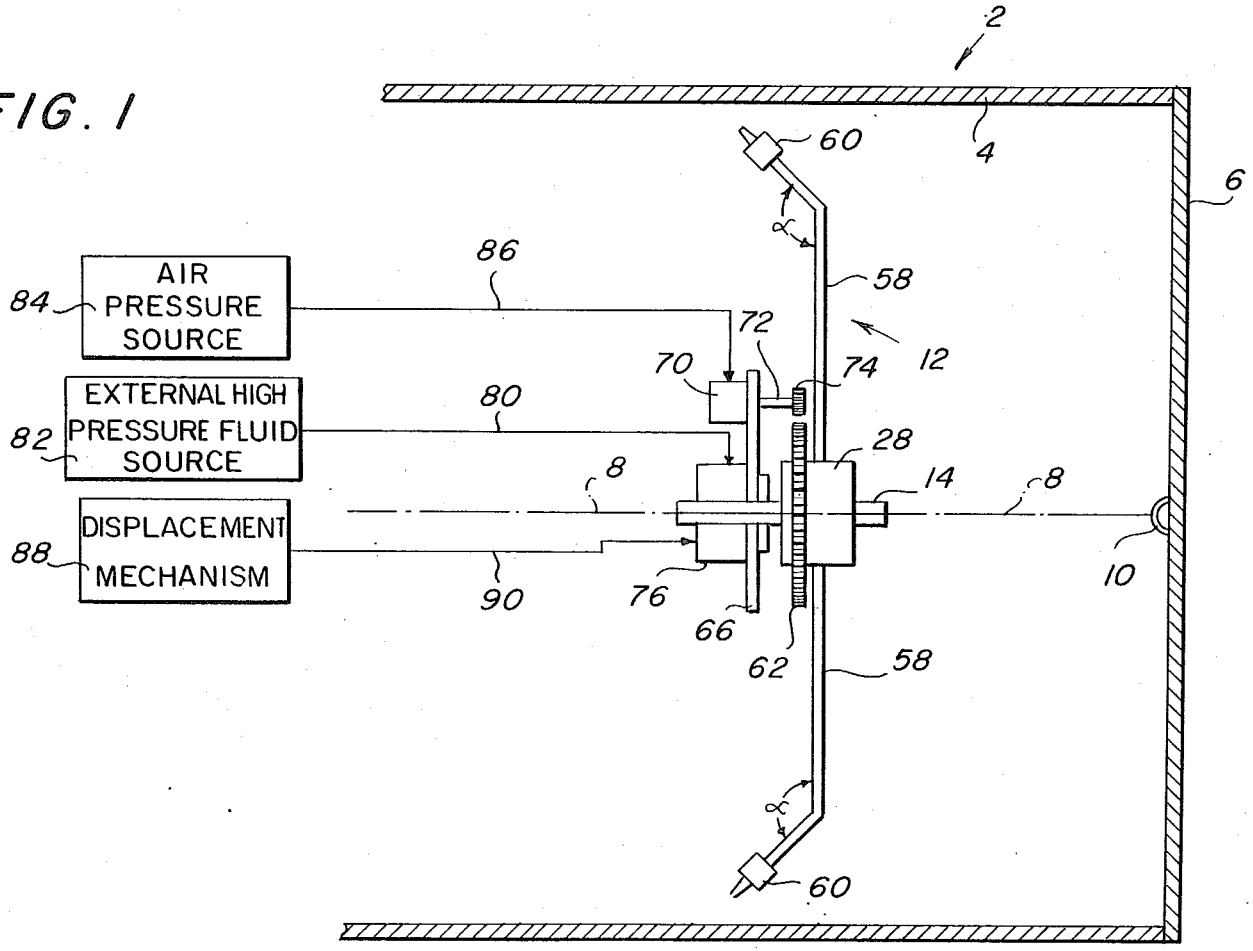
FIG. 1 is a plan view of the rotary cleaning device according to the invention arranged within the interior of the cylindrical housing to be cleaned.

Referring first to FIG. 1, there is shown a housing 2 such as that of a cyclone furnace or boiler having a cylindrical side wall 4 and a pair of end walls, only one 6 of which is shown. The housing has a horizontal longitudinal axis. It will be appreciated by those skilled in the art that the housing may also be arranged vertically, if necessary.

Extending along the housing axis is a fixed support such as a metal rod or cable 8. The use of a cable is preferred and the cable is formed of twisted steel threads as shown diagrammatically in FIG. 2. The cable is connected at opposite ends with the end walls of the housing such as by hooks or clasps 10 and is maintained in a a taut condition, whereby deviation of the cable from the housing axis is avoided. The rotary cleaning device 12 according to the invention is mounted on the cable within the housing chamber.

Figure 2:
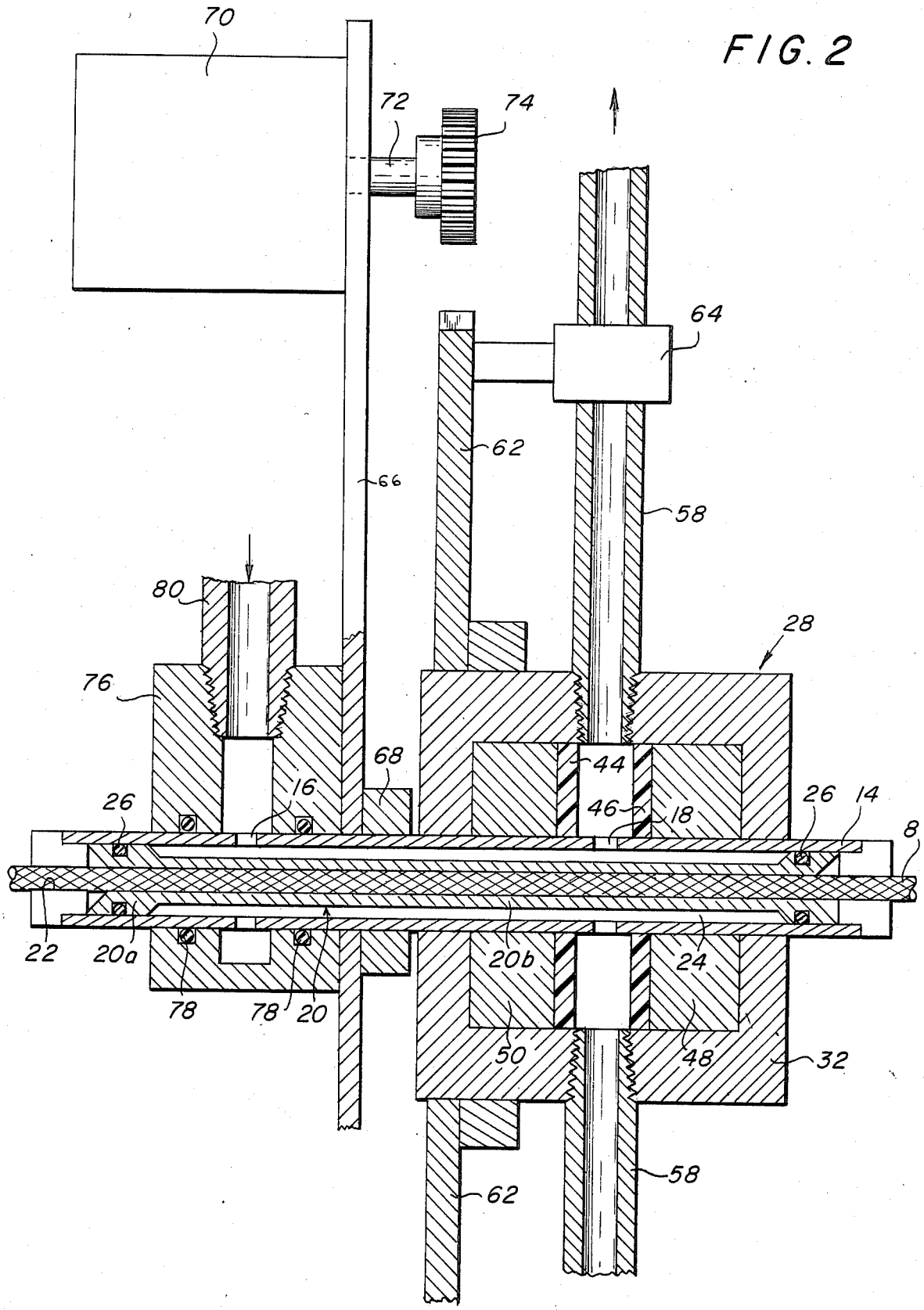
FIG. 2 is a detailed sectional view of the rotary cleaning device.

As shown more particularly in FIG. 2, a tubular shaft 14 is mounted on the cable. The shaft contains a plurality of fluid inlet openings 16 and a plurality of fluid outlet openings 18. The shaft also includes an insert 20 arranged therein, the insert having a longitudinal through-bore 22 adapted to receive the cable 8. The diameter of the through-bore 22 corresponds with the diameter of the cable. The insert is designed to permit longitudinal displacement of the shaft 14 along the length of the cable between the opposite ends walls of the housing and to prevent rotation of the shaft about the cable. The end portions 20*a* of the insert have an outer diameter corresponding with the inner diameter of the tubular shaft 14. The intermediate portion 20*b* of the insert has an outer diameter less than the inner diameter of the shaft, whereby an annular passage 24 is defined between the intermediate portion 20*b* of the insert and the inner wall of the shaft concentrically about the through-bore 22. The insert intermediate portion 20*b* extends at least between the fluid inlet openings 16 and the fluid outlet openings 18 in the shaft 14, to define a fluid flow path within the shaft between the inlet and outlet openings. Seals such as O-rings 26 may be provided between the insert end portions 20*a* and the inner surface of the shaft 14 to prevent fluid from escaping the annular passage between the insert end portions and the inner wall surface of the shaft.

In lieu of the insert, the shaft may be formed from a unitary piece of material such as stainless steel and provided with a through-bore for receiving the cable, a plurality of inlet and outlet openings, and an annular passage separate from and concentrically about the through-bore in fluid communication with the inlet and outlet openings.

Figure 3:
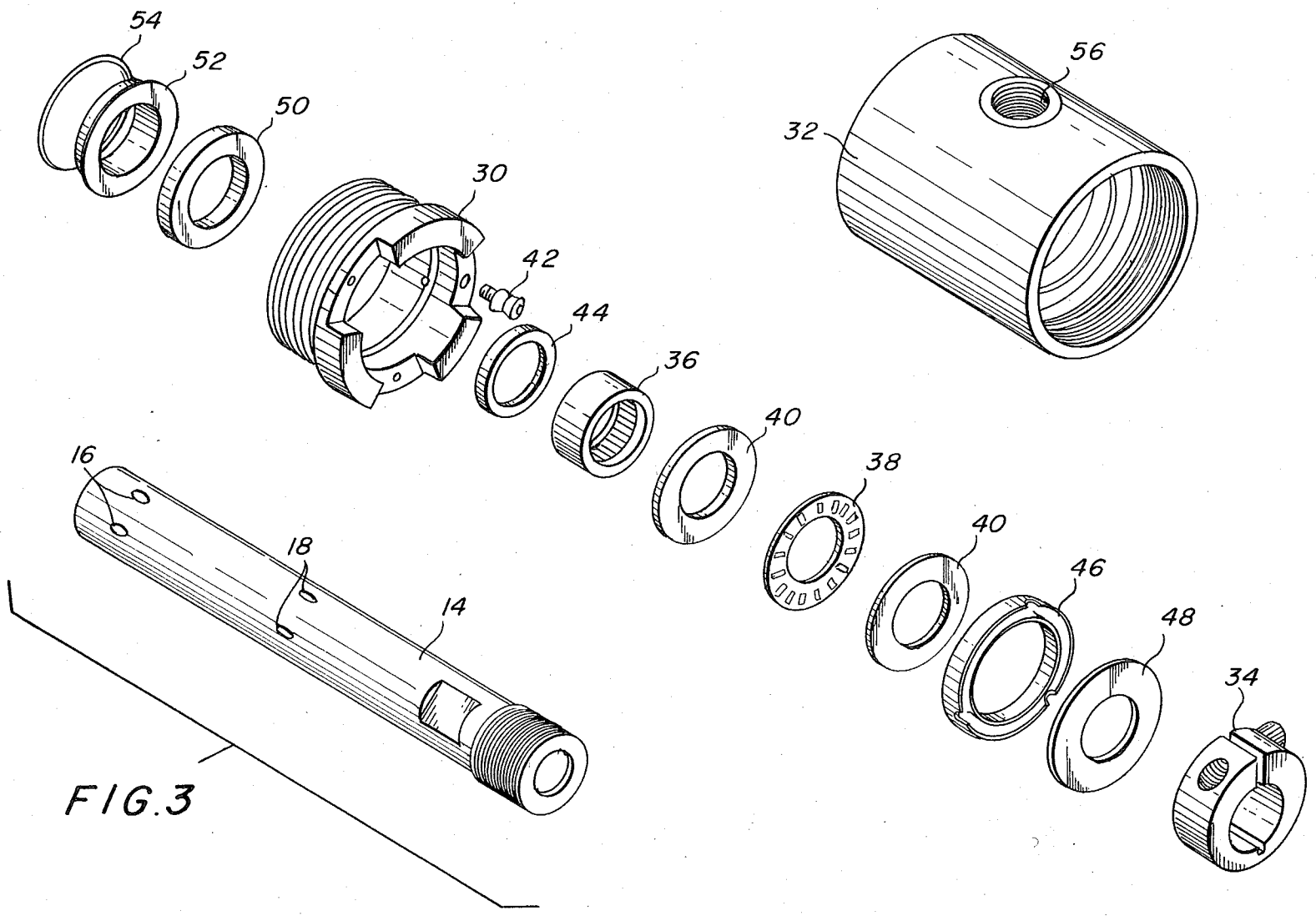
FIG. 3 is an exploded perspective view of the rotary swivel device.

A flange-seal swivel device 28 is rotatably connected with the shaft 14 adjacent the outlet openings 18. Referring now to FIG. 3, the swivel device will be described in detail. The swivel includes a nut 30, a cover 32, and a collar 34 for holding the swivel device together in a given longitudinal position on the shaft 14. A radial bearing 36 is arranged within the nut to allow the swivel device to rotate about the shaft 14. A thrust bearing 38 separated by washers 40 also assists in rotational movement of the swivel. A grease fitting 42 enables the nut and bearings to be lubricated, and excess grease forces dirt out of the cover. Grease seals 44, 46 are provided on opposite sides of the bearings. A retainer washer 48 is provided adjacent the collar 34. The flange seal 52 also prevents fluid seepage from the swivel and serves to direct fluid outwardly through openings 56 in the cover 32.

Referring once again to FIG. 2, the flange-seal swivel device 28 is shown with many of its interior components removed for simplicity and ease of understanding. As shown therein, the swivel includes the cover 32, high pressure seals 44 and 46 and the seal packing components such as the backup ring 50 and the washer 48.

The swivel cover 32 is provided with a pair of diametrically opposed threaded openings 56 adapted to receive the threaded ends of a pair of rigid lances 58 which extend radially outwardly in opposite directions from the swivel. Each of the lances has a nozzle 60 connected with the other end thereof with the nozzles being arranged adjacent the interior surface of the cylindrical wall of the housing as shown in FIG. 1. The lances are bent at their ends in the same direction, whereby the nozzles are arranged at an angle $\alpha$ relative to the radially extending portions of the lances 58. As shown in FIG. 2, a fluid flow path is shown from the shaft outlet openings 18 through the swivel to the interior of the lances for transporting fluid to the nozzle. Although only two lances are shown in the drawing, it will be appreciated that any number of radially extending lances may be provided. The lances would preferably be evenly spaced about the circumference of the swivel device which would contain additional openings affording fluid communication between the shaft outlet openings 18 and the additional lances via the fluid chamber defined within the swivel device between the seals.

A toothed sprocket 62 is connected with the swivel cover 32. A pair of stabilizer rings 64 are preferably connected with the lances 58 and with the sprocket to stabilize the lances during the cleaning operation. A mounting plate 66 is fixedly connected with the shaft 14 and spaced from the swivel device 28 by a spacer ring 68. A motor such as an air motor 70 is connected with the mounting plate and includes a drive shaft 72 with which is connected a drive sprocket 74 which drives the swivel sprocket 62 via a chain (not shown). When the motor is operated, the drive sprocket 72 drives the swivel sprocket 62 to rotate the swivel about the shaft 14, thereby to drive the cleaning nozzles 60 in a circular path adjacent the inner surface of the cylindrical wall 4.

A fluid coupler 76 is rigidly connected with the shaft adjacent the inlet opening 16 and O-rings 78 are provided between the coupler and the shaft to prevent fluid from leaking. A fluid supply conduit 80 is connected with the coupler to deliver fluid to the annular passage 24 of the shaft via the inlet openings.

At the exterior of the housing are provided a source 82 of high pressure cleaning fluid and a source 84 of air under pressure. The cleaning fluid is transported from the source 82 to the coupler via the conduit 80 and the air is delivered from the source 84 to the air motor 70 via a line 86 to operate the motor.

When the high pressure cleaning fluid is directed against the surface of the cylindrical wall, the force of the fluid striking the wall is sufficient to abrasively or hydraulically remove any deposits therefrom owing to fluid impact, including particulates, grease, grime, film and the like. When the motor 70 is actuated to continuously rotate the swivel about the shaft 14 and thus about the housing axis, the nozzles 60 traverse a circular path about the interior of the housing to clean a segment of the surface thereof.

Owing to the angular orientation of the nozzles relative to the lances, the forces generated by the expelled cleaning fluid tend to displace the rotary cleaning assembly in one direction along the cable and thus along the axis of the housing. In order to control the longitudinal movement of the cleaning device, an external displacement mechanism 88 is connected with the cleaning device via a line 90 to pull the cleaning device in the other direction along the cable against the forces generated by the expelled cleaning fluid. In this manner, the longitudinal position of the cleaning device and the speed of its longitudinal displacement may be controlled. Moreover, the motor controls the speed of rotation of the cleaning device. The combined rotational and longitudinal movement of the device enables the cleaning nozzles to traverse the entire interior surface area of the cylindrical wall to abrasively or hydraulically clean the same by fluid impact.

Owing to the unique shaft and swivel arrangement of the invention, the mounting plate, fluid coupler, air motor, and shaft do not rotate with the lances. Thus winding and tangling of the supply lines is avoided. Accordingly, continuous rotation of the cleaning lances is possible at any desired speed to enhance the total cleaning capabilities of the device.

Although the invention has been described as having an air motor as the drive source, other drive mechanisms such as an electric motor may be used.

The coupling, shaft, insert, swivel cover, lances and nozzles are all formed of a durable material such as stainless steel although synthetic plastics may also be used.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. Apparatus for cleaning the inner surface of a cylindrical housing such as a cyclone furnace, a horizontally oriented tank, and the like, comprising (a) a fixed support connected with the ends of the housing and extending along the axis thereof;

(b) a cylindrical shaft containing (1) an axial through-bore adapted to receive said support, said shaft being axially displaceable relative to the fixed support;

(2) an elongated annular passage concentrically arranged relative to and isolated from said through-bore; and (3) inlet and outlet opening means affording communication with said passage;

(c) an elongated generally cylindrical insert member arranged within said cylindrical shaft through-bore, said insert member containing a longitudinal through-bore adapted to receive said support, said insert member having end portions the outer diameter of which corresponds with the inner diameter of said shaft, said insert member further having an intermediate portion the outer diameter of which is less than the outer diameter of said end portions, said intermediate portion extending at least between said shaft inlet and outlet opening means, thereby to define said annular passage between the inner surface of said shaft and the outer surface of said insert member intermediate portion;

(d) cleaning means extending radially from said shaft and in communication with said passage via said outlet opening means, each of said cleaning means including a rigid lance and a nozzle connected with the end of said lance, said nozzle being arranged adjacent the surface to be cleaned;

(e) means for rotatably connecting said cleaning means with said shaft;

(f) drive means connected with said cleaning connecting means for rotating said connecting means about said shaft; and (g) means connected with said inlet opening means for supplying a cleaning fluid to said cleaning means via said passage, whereby when said drive means are operated to rotate said cleaning means and when said shaft is axially displaced along said support, said nozzles traverse both orbital and linear paths to direct said cleaning fluid against the entire interior surface of all of the cylindrical housing.

2. Apparatus as defined in claim 1, wherein said fluid supply means supplies said cleaning fluid at high pressure, whereby when said fluid is discharged from said nozzle, said fluid strikes the housing wall inner surface with sufficient impact force to remove particulates, film, and the like therefrom.

3. Apparatus as defined in claim 2, wherein said cleaning means comprises at least a pair of lances having nozzles connected with the ends thereof, respectively, said lances extending in radially opposite directions from said shaft.

4. Apparatus as defined in claim 3, wherein said insert member through-bore has a diameter corresponding with the diameter of said support.

5. Apparatus as defined in claim 4, wherein said means for rotatably connecting said cleaning means with said shaft comprises a sealed swivel.

6. Apparatus as defined in claim 5, wherein said swivel includes a sprocket, and further wherein said drive means include a motor for driving said sprocket.

7. Apparatus as defined in claim 6, wherein said drive means further includes a drive sprocket connected with said motor and a drive chain for connecting said swivel sprocket with said drive sprocket.

8. Apparatus as defined in claim 5, wherein said nozzles are arranged at an angle relative to said lances, whereby the force generated by said high pressure cleaning fluid as it is discharged from said nozzles tends to displace said shaft in one direction along said support.

9. Apparatus as defined in claim 8, and further comprising means for controlling displacement of said shaft along said support.

10. Apparatus as defined in claim 9, wherein said displacement controlling means is operable to displace said shaft along said support in the other direction.

11. Apparatus as defined in claim 10, wherein said support comprises a cable.

* * * * *